US007905729B2

(12) United States Patent
Goosens et al.

(10) Patent No.: US 7,905,729 B2
(45) Date of Patent: Mar. 15, 2011

(54) BOARD-TO-BOARD CONNECTOR

(75) Inventors: Thierry Clementine Louis Maria Goosens, Herdersem-Aalst (BE); Bernardus Lambertus Franciscus Paagman, Schijndel (NL); Eugène Maria Brinkhof, Weert (NL); Ludwig Gerardus Martinus Antonius Lange, Vinkel (NL)

(73) Assignee: FCI, Versailles (FR)

( * ) Notice: Subject to any disclaimer, the term of this patent is extended or adjusted under 35 U.S.C. 154(b) by 94 days.

(21) Appl. No.: 11/813,623

(22) PCT Filed: Feb. 18, 2005

(86) PCT No.: PCT/EP2005/001820

§ 371 (c)(1),
(2), (4) Date: Jul. 10, 2007

(87) PCT Pub. No.: WO2006/074701

PCT Pub. Date: Jul. 20, 2006

(65) Prior Publication Data

US 2008/0207011 A1 Aug. 28, 2008

(30) Foreign Application Priority Data

Jan. 11, 2005 (NL) ..... 1027992

(51) Int. Cl.
*H01R 12/00* (2006.01)

(52) U.S. Cl. ..... 439/61

(58) Field of Classification Search ..... 439/61, 439/65

See application file for complete search history.

(56) References Cited

U.S. PATENT DOCUMENTS

| | | | | | |
|---|---|---|---|---|---|
| 4,204,737 | A | | 5/1980 | Faber et al. | 339/65 |
| 4,232,924 | A | * | 11/1980 | Kline et al. | 439/74 |
| 4,334,732 | A | | 6/1982 | Roeschlein et al. | 339/176 |
| 4,498,717 | A | | 2/1985 | Reimer et al. | 339/17 |
| 4,932,885 | A | | 6/1990 | Scholz | 439/79 |
| 4,954,086 | A | | 9/1990 | Hill et al. | 439/65 |
| 4,993,965 | A | | 2/1991 | Eck | 439/374 |
| 5,066,236 | A | * | 11/1991 | Broeksteeg | 439/79 |
| 5,924,899 | A | | 7/1999 | Paagman | |
| 5,926,378 | A | * | 7/1999 | DeWitt et al. | 361/788 |
| 6,039,590 | A | | 3/2000 | Kunishi | 439/247 |
| 6,129,557 | A | * | 10/2000 | Blaszczyk et al. | 439/61 |
| 6,163,464 | A | * | 12/2000 | Ishibashi et al. | 361/788 |
| 6,319,051 | B1 | | 11/2001 | Chang et al. | 439/490 |
| 6,392,142 | B1 | * | 5/2002 | Uzuka et al. | 174/541 |
| 6,457,993 | B1 | | 10/2002 | Espenshade | |
| 6,478,610 | B1 | | 11/2002 | Zhou et al. | 439/490 |
| 6,533,587 | B1 | | 3/2003 | Potter et al. | 439/65 |

(Continued)

FOREIGN PATENT DOCUMENTS

EP 1 418 645 5/2004

*Primary Examiner* — Ross N Gushi
(74) *Attorney, Agent, or Firm* — Woodcock Washburn LLP

(57) ABSTRACT

The invention relates to a board-to board connector (9) comprising at least a first contact module (9*a*) with a first set of board contacts (20) for connecting to a first board (8), and a second contact module (9B) with a second set of board contacts (21). The connector further comprises an interconnection element (22) for interconnecting at least one of said first set of contacts with at least one of said second set of contacts. The interconnection element enables rerouting and compensation of skew.

28 Claims, 14 Drawing Sheets

U.S. PATENT DOCUMENTS

| | | | | |
|---|---|---|---|---|
| 6,608,762 | B2 * | 8/2003 | Patriche | 361/788 |
| 6,699,065 | B1 | 3/2004 | Espenshade et al. | |
| 6,805,560 | B1 | 10/2004 | Budny et al. | 439/65 |
| 6,890,200 | B1 | 5/2005 | Wu | 439/247 |
| 7,175,446 | B2 | 2/2007 | Bright et al. | 439/79 |
| 7,261,591 | B2 | 8/2007 | Korsunsky et al. | 439/541 |
| 7,336,502 | B1 * | 2/2008 | Goergen | 361/788 |
| 2002/0072255 | A1 | 6/2002 | Leman | 439/61 |
| 2002/0086582 | A1 * | 7/2002 | Nitta et al. | 439/608 |
| 2003/0049948 | A1 * | 3/2003 | Kim et al. | 439/61 |
| 2003/0114027 | A1 * | 6/2003 | Wurster | 439/82 |
| 2004/0097112 | A1 | 5/2004 | Minich et al. | 439/101 |
| 2004/0235321 | A1 | 11/2004 | Mizumura et al. | 439/92 |
| 2005/0009402 | A1 | 1/2005 | Chien et al. | |
| 2005/0287834 | A1 | 12/2005 | Nishimura et al. | 439/67 |
| 2009/0004892 | A1 | 1/2009 | Weber | |

* cited by examiner

BOARD-TO-BOARD CONNECTOR

The invention relates to a board-to-board connector configured to connect a first board to a second board. In particular, the invention relates to low or high speed card edge connectors, for example, those configured to connect an advanced mezzanine card (AMC) or board to a carrier board in an advanced telecom cabinet architecture (ATCA) system or proprietary system.

The general use of daughter boards supported by or connected to a base board, carrier board or motherboard is well established. For example, the motherboard of a personal computer typically accepts a plurality of daughter boards that plug into sockets on the motherboard so that the daughter boards are mounted perpendicular to the motherboard. This arrangement promotes configurability and flexibility, since different daughter boards that provide different functions can be selected for use with a motherboard.

Mezzanine boards have also been used to provide similar configurability and functionality. As used herein, a "mezzanine board" refers to a circuit board that is mounted [coplanar] in a plane generally parallel to the plane of its associated base board.

U.S. Pat. No. 6,805,560 discloses an apparatus including a circuit board and a connector assembly which extends outwardly from the circuit board and is capable of simultaneously being connected to a plurality of mezzanine cards. The connector assembly has a main body that extends outwardly and orthogonal from the circuit board and is connected to this circuit board. The main body, which may take the form of a sandwich of numerous layers including signal lines, comprises a plurality of connectors arranged for connection to a respective mezzanine card.

A problem associated with the prior art is the limited flexibility of the connector assembly to comply with different situations, such as different footprints on the circuit board or backpanel.

It is an object of the present invention to provide a board-to-board connector with enhanced flexibility.

This object is accomplished by a board-to-board connector comprising at least a first contact module with a first set of board contacts for connecting to a first board, and a second contact module with a second set of board contacts, wherein said connector further comprises an interconnection element for interconnecting at least one of said first set of board contacts with at least one of said second set of contacts.

The modular configuration of the board-to-board connector provides enhanced flexibility, since the interconnection element or transition element, that preferably is a separate component of the connector, in principle allows to electrically connect any of said first set of board contacts with any of said second set of board contacts. Accordingly, there is no need to adapt the first and second contact module to customer specific requirements; only the interconnection element should be adapted. Such customer specific requirements may e.g. relate to different AMC module arrangements like B, B+, AB and/or A+B+ and/or the footprint of the carrier board in ATCA systems.

In an embodiment of the invention, the first set of board contacts is provided in a first arrangement and the second set of board contacts is provided in a second arrangement, wherein the second arrangement is different from said first arrangement. The interconnection element facilitates the transition in arrangement between the first and second set of board contacts. Preferably, the first arrangement involves a substantially linear array of board contacts and said second arrangement involves a two-dimensional array of board contacts. The first set of board contacts may comprise edge type board contacts.

In a preferred embodiment of the invention, the interconnection element comprises at least one printed circuit element. Such a printed circuit element may e.g. comprise a printed circuit board (PCB) or a flexcircuit with one or more conductive tracks for interconnecting said first set of board contacts and said second set of board contacts. These types of interconnection elements provide excellent track routing possibilities and are relatively inexpensive. Preferably, electrical connection with the tracks is established by means of vias associated with the respective tracks and adapted to couple with the first set and second set of board contacts.

In an embodiment of the invention said first set of board contacts is arranged to contact a first board with a normal in a first direction and said second set of board contacts is arranged to contact a second board with a normal in said first direction and wherein said printed circuit element has a normal in a second direction, perpendicular to said first direction. This orientation of the printed circuit element is suitable for an ATCA system.

In an embodiment of the invention, the printed circuit element comprises a sequentially laminated printed circuit board. This embodiment allows independent coupling of the first set and second set of board contacts on both sides of the interconnection element. Preferably, the sequentially laminated printed circuit board comprises a first set of ended vias in a first layer of said sequentially laminated printed circuit board associated with set first set of board contacts and a second set of ended vias in a second layer of said sequentially laminated printed circuit board associated with said second set of board contacts.

In an embodiment of the invention, at least two of said conductive tracks have different track lengths. The different track lengths in the printed circuit board or printed wired board enable manipulating the time of arrival of signals transmitted over these tracks by making some tracks longer than others. This effect is also referred to as skew compensation. Preferably, the conductive tracks are arranged such that impedance can be controlled.

In an embodiment of the invention, the second contact module comprises at least one contact array of electrically conductive leads extending in a lead frame from said interconnection element to define said second set of board contacts. Such a second contact module, hereinafter also referred to as insert molded leadframe assembly (IMLA), may provide a right-angled contact module capable of maintaining signal integrity in high speed applications, such as connecting an AMC in an ATCA system.

In a preferred embodiment of the invention, the second contact module comprises at least a first contact array and a second contact array of electrically conductive leads extending in respectively a first and second lead frame and wherein said second lead frame is disposed adjacent to said first lead frame and cross talk is limited in the absence of a shielding plate between the first and second lead. This connector module, known in the connector field by the trademark AirMax VS™ of the applicant, does not comprise interleaving shields between adjacent leads, while maintaining acceptable cross talk performance at high speeds. Advantages of such a second contact module employing AirMax VS™ technology include the reduced weight of the second contact module, enhanced impedance control and improved manufacturability.

In an embodiment of the invention, the second contact module comprises a linear contact array of edge coupled electrically conductive leads. In a preferred embodiment, the board-to-board connector can transmit high speed signals in excess of about 1.0 Gb/sec with a near-end differential cross talk less than about 3% and/or far-end differential cross talk of less than about 4% measured as specified in the PICMG 3.0 RC 1.1 specification of Dec. 3, 2004 for ATCA systems. Preferably, the high speed signals are in excess of 6 Gb/sec or even 12 Gb/sec.

In a preferred embodiment of the invention, the second set of board contacts comprise non-compression contacts, selected from the group comprising solder pin contacts, press-fit contacts, pin-in-paste contacts and ball grid array contacts. Such non-compressive board contacts omit the need for a continuous force to be applied by e.g. a spring element to maintain adequate board contact with the second board, i.e. in particular the carrier board or the backplane.

In a preferred embodiment of the invention, the second set of board contacts a further printed circuit board on a first side and comprises ball grid array (BGA) solder points on an opposite side adapted to connect to a board. The further printed circuit board allows adaptation to the footprint of the second board of the customer and improves co-planarity with respect to direct application of the BGA solder points on the IMLA leads.

In a preferred embodiment of the invention, the inter-connection element comprises a printed circuit board and said second contact module is connected to said printed circuit board by press-fit connections. This embodiment allows mounting of the second set of board contacts to the second board in a lead-free mounting process. Such a process is typically performed at higher temperatures than in conventional mounting processes involving the use of lead. The press-fit connections according to this embodiment are not detrimentally influenced by these higher temperatures.

It should be appreciated that the above described embodiments, or aspects thereof, can either be combined or applied in isolation. E.g. the invention also relates to a board-to-board connector comprising at least a first contact module with a first set of board contacts for connecting to a first board and a second contact module with a second set of board contacts for connecting to a second board, wherein said first set of board contacts are edge board contacts and said second contact module is a leadframe assembly, preferably insert moulded, defining a portion of a two-dimensional array of said second board contacts. The second board contacts are preferably edge coupled, which allows high contact density without sacrificing performance at higher speeds.

The invention moreover relates to a connector assembly comprising at least a first board, a second board and a connector comprising at least a first contact module with a first set of board contacts for connecting to said first board and a second contact module with a second set of board contacts for connecting to said second board, wherein said connector further comprises an interconnection element for interconnecting at least one of said first set of contacts with at least one of said second set of contacts.

The interconnection element, that preferably is a separate component of the connector, in principle allows to electrically connect said first board via any of said first set of board contacts with any of said second set of board contacts on said second board. Accordingly, there is no need to adapt the first and second contact module to customer specific requirements; only the interconnection element may be adapted.

Advantageous embodiments of the connector assembly are defined in claims 22 and 23.

The invention further relates to a connector module comprising a contact array of electrically conductive leads extending in a lead frame accommodating said conductive leads between a first row of board contacts and a second row of board contacts, wherein said electrically conductive leads are separated by gaps with air as a dielectric. Such an IMLA with board contacts on both sides of the leads is an advantageous contact module for an AMC connector.

In an embodiment of the invention, the first and second rows of board contacts are selected from the group comprising press-fit contacts, pin-in-paste contacts and ball grid array contacts. These non-compressive contacts omit the need for applying a continuous force for mounting the first and second rows of contacts on respective boards.

The invention also relates to a cabinet arranged for communication purposes comprising a board-to-board connector or a mezzanine connector assembly as described above. As already described, such connectors and connector assemblies are advantageously applied in ATCA systems or proprietary systems by telecom operators and/or OEM's as a result of the hot swappability of the mezzanine cards and the high speed performance of such systems ranging from speeds less than 2.5 Gbits/s to speeds in excess of 12.5 Gbits/s.

The invention will be further illustrated with reference to the attached drawings, which schematically show preferred embodiments according to the invention. It will be understood that the invention is not in any way restricted to these specific and preferred embodiments.

In the drawings:

FIGS. 1A-1C display a schematic illustration of a telecommunication cabinet and a detailed portion in an ATCA set-up;

Figure 1A:
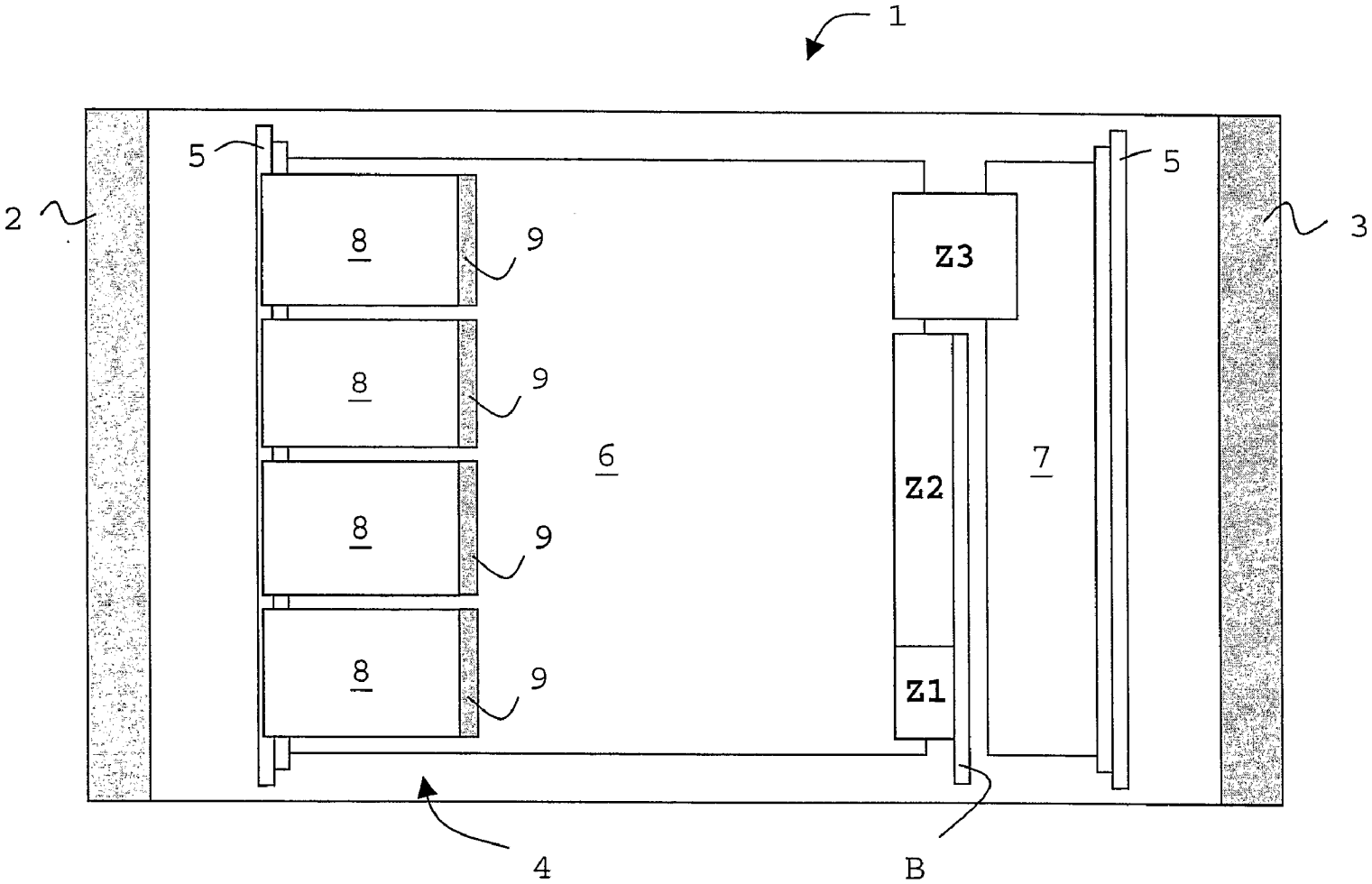
Figure 1C:
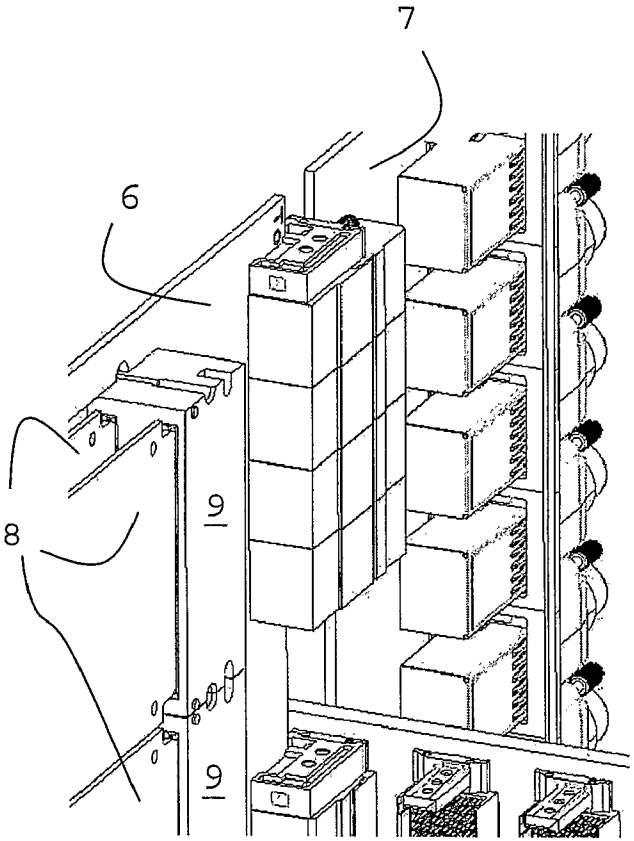
Figure 1B:
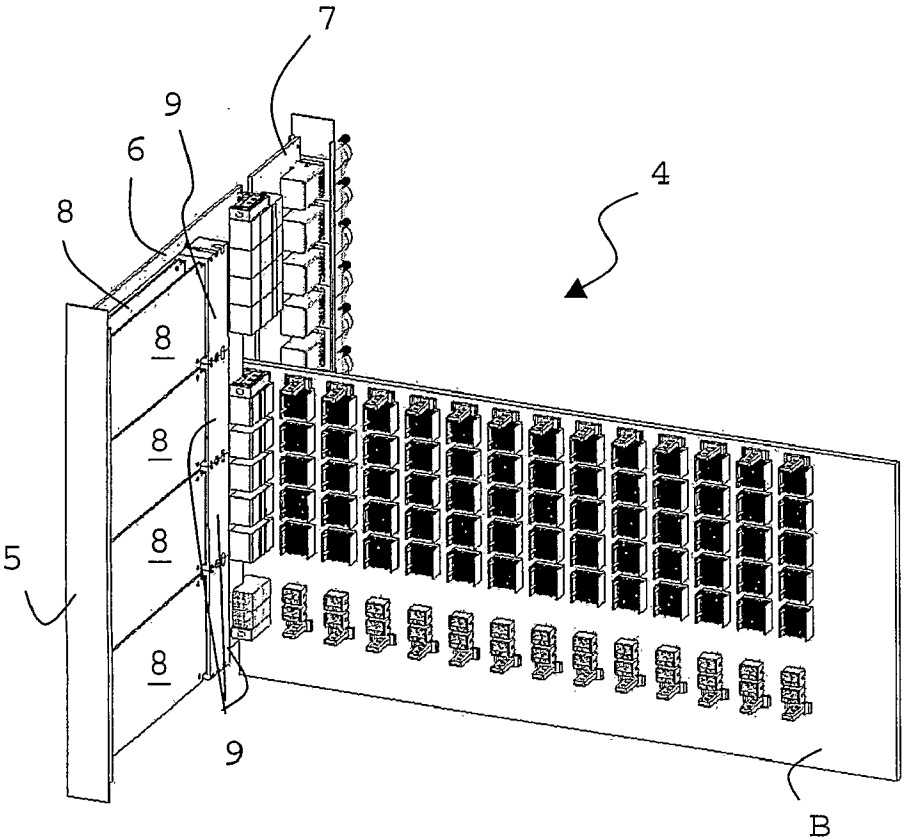

FIGS. 1A-1C show a telecommunication cabinet 1 and detailed portions thereof in an AdvancedTCA (ATCA) arrangement, defined by a front access door 2 and a rear access door 3. The cabinet 1 accommodates a connector assembly 4 in a rack, leaving spaces for optical and metallic cabling. The connector assembly 4 is determined by faceplates 5 holding a front board or carrier board 6 and a rear transition module 7. The carrier board 6 has a dedicated first zone Z1 and second zone Z2 with connectors for power and system management respectively data transport. Additional zone Z3 has connectors for connecting the carrier board 6 and the rear transition module 7.

At the front face plate 5, daughter cards or boards 8 may be placed, extending parallel to the carrier board 6. Such boards 8 may e.g. comprise PCI mezzanine cards (PMC's) or advanced mezzanine cards (AMC's), comprising e.g. a signal processor and/or other additional components. Components may be placed on both sides of the board 8, dependent on the configuration. These boards 8 can be introduced through slots (not shown) in the front face plate 5 for connecting to corresponding board-to-board connectors 9. The board-to-board connectors 9 will hereinafter also be referred to as connectors 9. The connectors 9 reside on the carrier board 6 at the rear of the boards 8. Once connected, data transport may take place between the board 8 and the rear transition module 7 or backplane B via the carrier board 6. The boards 8 may be designed to be hot swappable into the connectors 9.

The sizes of the boards 8, or more accurately, the I/O modules, i.e. the combination of a board 8 and a connection module at the front face plate 5 allowing connection to the boards 8, are standardized and commonly indicated by the terms single-width, double-width, full-height and half-height.

The carrier board 6 may be a conventional carrier or a cutaway carrier. The term conventional carrier refers to a carrier board without any required cut-outs and allows components to be placed on the carrier board 6 below the boards 8. Conventional carriers support full-height modules only. Half-height modules require a full-height faceplate 5 in which case they are therefore referred to as full-height modules. Conventional carriers 6 also support up to four single-width or two double-width modules across a carrier board 6. The term cutaway carrier is derived from the fact that the carrier board 6 below the boards 8 must be cut-away to support stacked boards 8. By cutting the carrier board 6, this permits the maximum component height possible for half-height modules. Full-height modules can be inserted into the upper bay of a cutaway carrier when the lower bay is unoccupied. Cutaway carriers 6 can support up to eight single-width, half-height Modules (see FIG. 1B) or four double-width, half-height modules across a carrier board 6. A maximum stacking of two modules is possible.

It is noted that the above description of FIGS. 1A-1C only highlights the basic elements of the ATCA system and AMC. The ATCA system is described in further detail in the draft PICMG 3.0 RC1.1 specification of Dec. 3, 2004. AMC is described in further detail in the PICMG Advanced Mezzanine Card AMC.0 specification D0.97 of Sep. 17, 2004. Both specifications are incorporated in the present application by reference with respect to the mechanical and electrical features of the carrier board 6, the AMC 8 and the board-to-board connector 9 and their mechanical and electrical interaction.

FIGS. 2-8B show a board-to-board connector 9 and several elements thereof according to a first embodiment of the invention.

Figure 2:
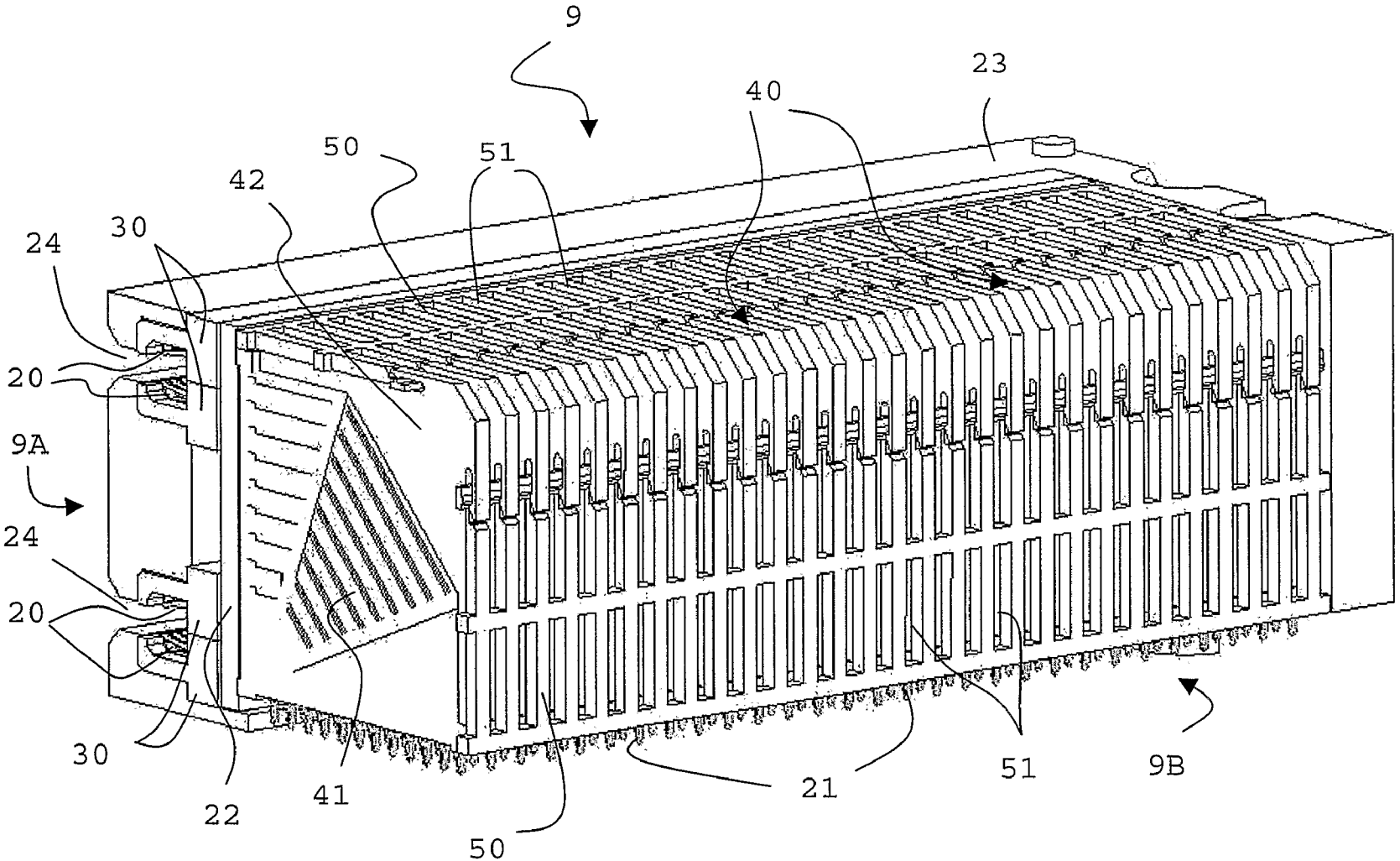
FIG. 2 shows a board-to-board connector according to a first embodiment of the invention.

In FIG. 2, the board-to-board connector 9 comprises a first contact module 9A with a first set of board contacts 20 for connecting to a first board 8, e.g. a PMC or AMC 8, and a second contact module 9B with a second set of board contacts 21 for connecting to a second board, e.g. the carrier board 6 of an ATCA system. The board-to-board connector 9 further comprises a transition element or interconnection element 22 for interconnecting at least one of said first set of contacts 20 with at least one of said second set of contacts 21. The second contact module comprises a plurality of contact arrays 40.

The modular configuration of the board-to-board connector 9 provides enhanced flexibility, since the interconnection element 22, that preferably is a separate component of the connector 9, in principle allows to electrically connect any of said first set of board contacts 20 with any of said second set of board contacts 21. Accordingly, there is no need to adapt the first contact module 9A or second contact module 9B to customer specific requirements; only the interconnection element 22 may be adapted. Such customer specific requirements may e.g. relate to different AMC module arrangements like B, B+, AB and/or A+B+ and/or the footprint of the carrier board in ATCA systems. The connector 9 is suitable to meet stringent signal integrity performance requirements for high speed applications.

The first set of board contacts 20 is provided in substantially linear array of edge type board contacts to contact the AMC 8, whereas the second set of board contacts 21 involves a two-dimensional array to connect to the carrier board 6. The second set of board contacts 21 comprise preferably non-compressive contacts, selected from the group comprising solder pin contacts, press-fit contacts, pin-in-paste contacts and ball grid array contacts.

The first contact module 9A, the interconnection element 22 and the second contact module 9B are preferably contained in a single housing 23. In FIG. 2, a side wall of the housing 23 is omitted for clarity purposes. The housing 23 comprises one or more slots 24 for accommodating first sets of board contacts 20.

The interconnection element 22 comprises a printed circuit board (PCB) for interconnecting the first contact module 9A and 9B. Hereinafter, the interconnection element 22 will also be referred to as PCB 22.

Next, some elements of the board-to-board connector 9 will be discussed in more detail with reference to FIGS. 3A-8B.

Figure 3B:
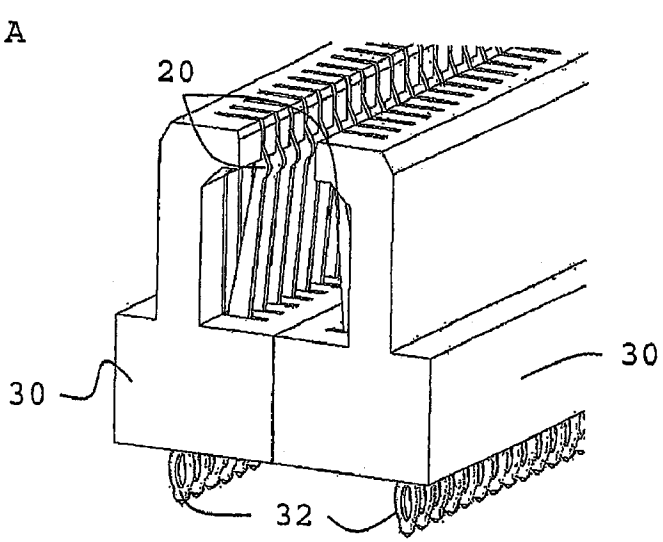
FIGS. 3A-3C show a first set of board contacts in perspective and in cross-section A-A according to an embodiment of the invention.
Figure 3A:
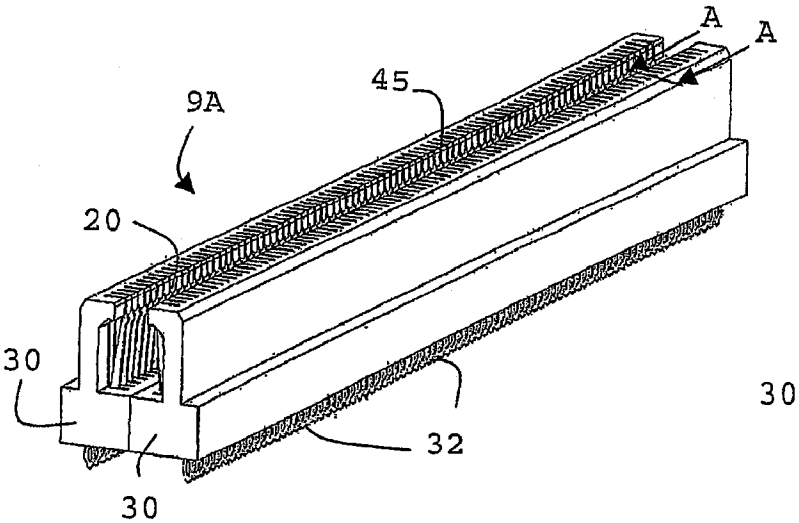
Figure 3C:
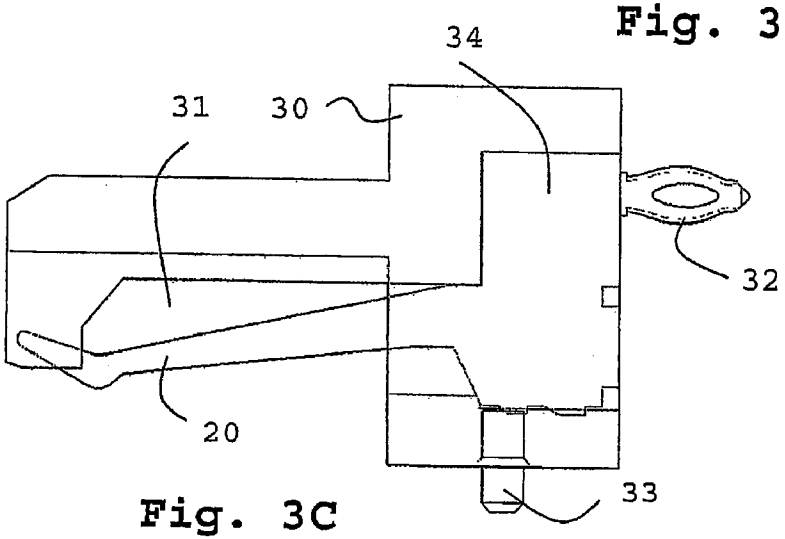

FIGS. 3A-3C show the first set of board contacts 20 in perspective and in cross-section A-A according to an embodiment of the invention.

The PICMG AMC.O specification distinguishes between AB and B connectors 9, both of which come in a basic and an extended variant. The basic first contact module 9A is associated with boards 8 equipped with conductive traces on only one side of the board 8. This provides cost and real estate savings for designs that do not need a large amount of I/O connectivity. The first contact module 9A for the single-sided design contains 85 board contacts 20 per slot 24 and is designated simply as either B or AB. The extended first contact module 9A provides connectivity to conductive traces on both sides of the edge of the card 8. The contact module 9A for the two-sided design contains 170 board contacts per slot 24 and is designated with a "+" following the connector type (e.g., B+ and A+B+).

The first set of edge type board contacts 20 shown in FIGS. 3A-3C is for a "+" type connector 9. The first set of contacts comprises a plurality of metallic beams 45 accommodated in an insulating holder part 30. The beams 45 are arranged such that they protrude from the holder part 30 allowing them to contact the AMC 8 and to develop an appropriate contact force. To that end, the beams 45 are allowed to elastically deform to some extent by a space 31. Each of the metallic beams 45 is conduc-tively coupled to a corresponding press-fit connection 32. Holder parts 30 can be coupled by a mounting pin 33. The holder part or parts 30 are subsequently inserted in a slot 24 of the board-to-board connector 9. In that position, the press-fit connections 32 contact the PCB 22.

It should be noted that the first set of contacts 20 shown in FIG. 3A may also be applied to connect a board 8, such as an PMC or AMC, directly to a backplane. In such a case, e.g. in a Micro telecom cabinet architecture (MicroTCA), the board 8 does not transmit signals over the carrier board 6 but directly to a backplane. The holder parts 30 may be housed in an additional housing in such an application. The press-fit connections 32, although preferred, may also or in addition be formed of other types of non-compressive or compressive connections, including ball grid array (BGA) or pin-in-paste (PIP) connections and/or springs.

Figure 4:
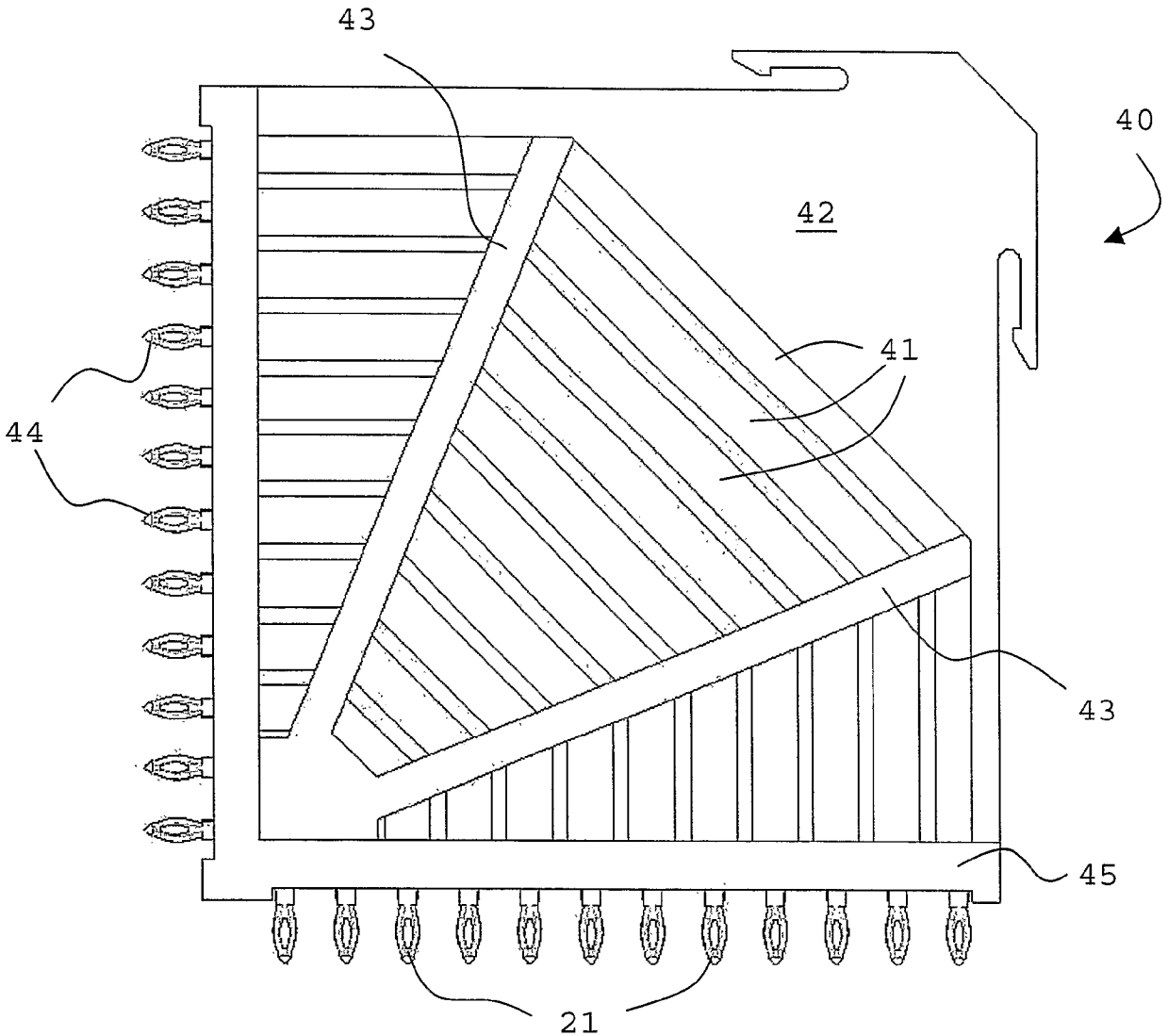
FIG. 4 shows a connector module according to an embodiment of the invention.
Figure 5:
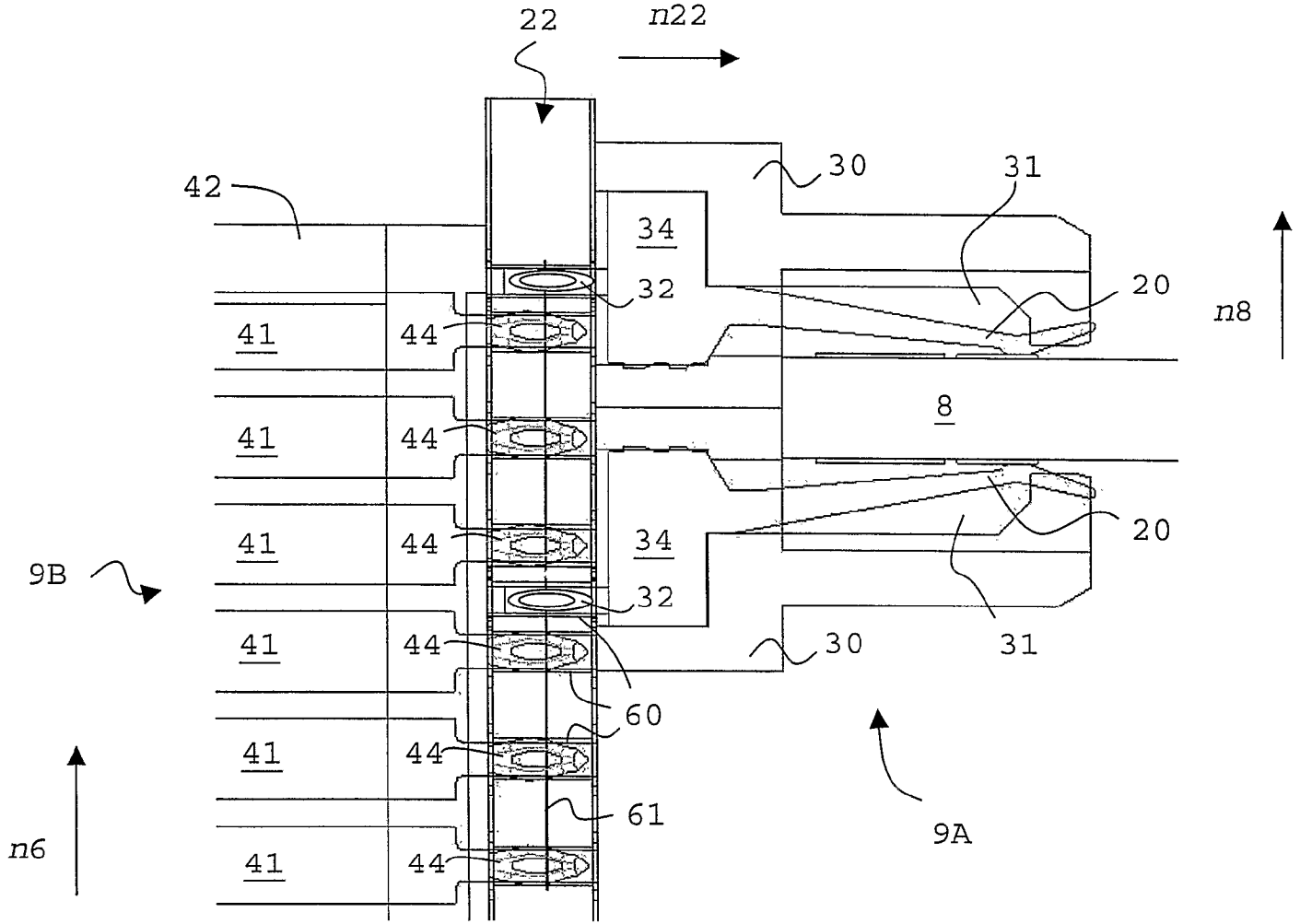
FIG. 5 shows a detailed portion of the board-to-board connector of FIG. 2 in cross-section including the first board.

FIG. 4 shows a single contact array 40 (see also FIG. 2) applied for the second contact module 9B. The right-angled contact array 40 comprises a plurality of electrically conductive leads 41 inserted in an insulating frame 42 defining the second set of board contacts 21 for transmitting signals between the carrier board 6 and board 8. The contact array further has support structures 43 for holding the leads 41 at particular locations. Such a contact array 40 will hereinafter also be referred to as insert molded leadframe assembly (IMLA). The IMLA can be used, amongst others, for either differential pair signals, such as low voltage differential signals (LVDS), and single ended signals. IMLAs can have plug contact ends, receptacle contact ends, press-fit ends, surface mount ends, or another type of electrical termination.

The IMLA 40 comprises non-compression contacts both for the second set of contacts 21 as for contacts 44 to connect to the PCB 22. The non-compression contacts 44 preferably comprise press-fit contacts, as shown in FIG. 4. This is particularly advantageous when the second set of non-compressive contacts 21 is mounted to the carrier board 6 by heating, especially in a lead-free reflow process. As these types of mounting processes involve elevated temperatures, already mounted contacts 44 of the board-to-board connector 9 are also exposed to these temperatures. Contacts 44, other than press-fit contacts, may be detrimentally affected by these elevated temperatures.

It should be appreciated that the IMLA 40 of FIG. 4 may be used as a contact array forming at least a part of the second contact module 9B, but may also be applied as a connector on its own.

The second contact module 9B shown in FIG. 2 has a plurality of IMLA's 40 as shown in FIG. 4. The IMLA's 40 are supported by a support housing 50 that may either be an integral part of the housing 23 or constitute a separate or modular structure for the second contact module 9B.

A particularly relevant aspect of the invention relates to the arrangement of IMLA's 40 in the support housing 50. As clearly visible in FIG. 2, the IMLA's 40 are positioned adjacent to each other. Contacts in each IMLA 40 are edge coupled with a dielectric, such as an air gap, in between. Electrical contacts in adjacent IMLAs are broad-side coupled with a dielectric, such as an air gap in between. Cross talk between the various IMLA's is limited without employing an interleaving shielding plate between adjacent IMLA's. Instead, the air gap is preferably used as a dielectric medium. This feature of the invention is described in US 2004/0097112, which describes in detail how a contact module 9B achieves this effect and is herewith incorporated by reference in the present application. Another feature to reduce cross-talk is mainly achieved by the selective designation of leads 41 as either ground leads or signal leads, e.g. as differential signal pairs or single ended leads, for adjacent IMLA's 40 to reduce the effect of electromagnetic fields for adjacent IMLA's. The leads 41 of adjacent IMLA's 40 may be offset with respect to each other. The elimination of the shielding plates results in a low cost and low weight contact module 9B.

The IMLA's 40 are arranged in the support housing 50 leaving spaces between adjacent lead frames 42. The support housing 50 determines access openings 51 allowing access to these spaces. The support housing 50 in this embodiment comprises a grid with a plurality of bars with access openings 51 defined between these bars corresponding to the spaces between the lead frames 42. As the insertion force for mounting the board-to-board connector 9 on the carrier board 6 may yield up to 14 kN, the access opening allows insertion of a tool to press the connector 9 using press-fit board contacts 21 onto the carrier board 6 as close as possible to these contacts 21. This is facilitated by a broadened structure 45 (most clearly shown in FIG. 6A) on the lead frame 42. The access openings 51 may also be applied to mount the press-fit connections 44 of the second contact module of IMLA's on the PCB 22.

FIGS. 5-8B relate to a particularly relevant aspect of the invention, i.e. the interconnection element 22. The interconnection element 22 preferably comprises a PCB, but may e.g. also comprise a flexcircuit (see FIG. 13). The interconnection element 22 interconnects the board contacts 20 of the first contact module 9A to the board contacts 21 of the second contact module 9B to form a modular type board-to-board connector 9.

Assuming a first board 8 and second board 6 to have a normal n8 respectively n6 in a first direction, the PCB 22 is arranged with a normal n22 in a second direction, perpendicular to said first direction.

A standard PCB 22 comprises vias 60 for mounting the press-fit connections 32 of the edge-type boards contact 20 and the press-fit connections 44 of the IMLA's 40. Mechanical conflicts between the connections 32 and 44 are avoided by positioning the connections 32 and 44 next to each other. In this embodiment, intelligent positioning of the press-fit connections 32 on rear ends 34 of the beams 45 is applied. As clearly illustrated in FIGS. 5 and 6B (in FIG. 6B, the frames 42, PCB 22 and holders 30 are omitted for reasons of clarity), the location of press-fit connection 32 at the rear end 34 is different for the upper first set of board contacts 20 and the lower first set of board contacts 20.

Figure 6B:
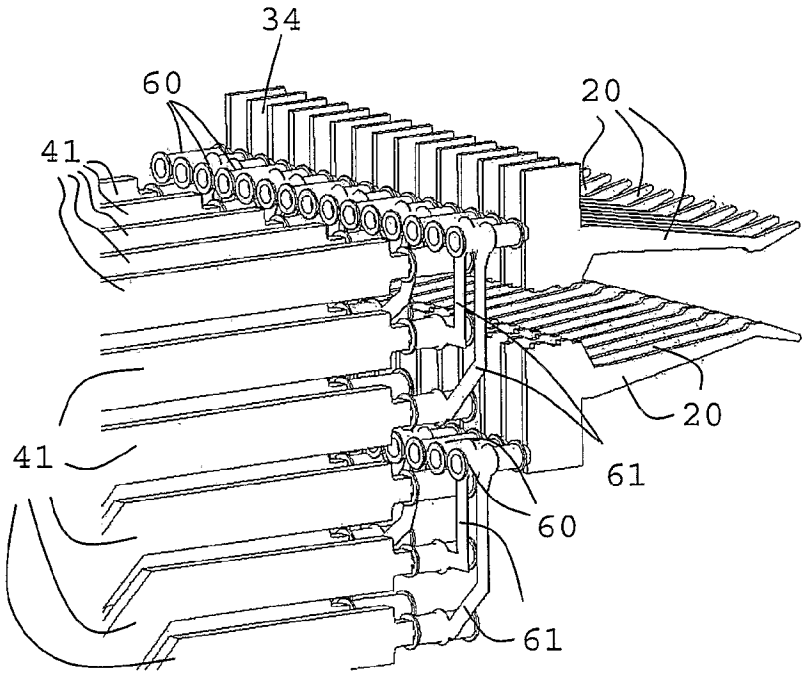
FIGS. 6A and 6B show detailed representations of portions of the board-to-board connector of FIG. 2.
Figure 6A:
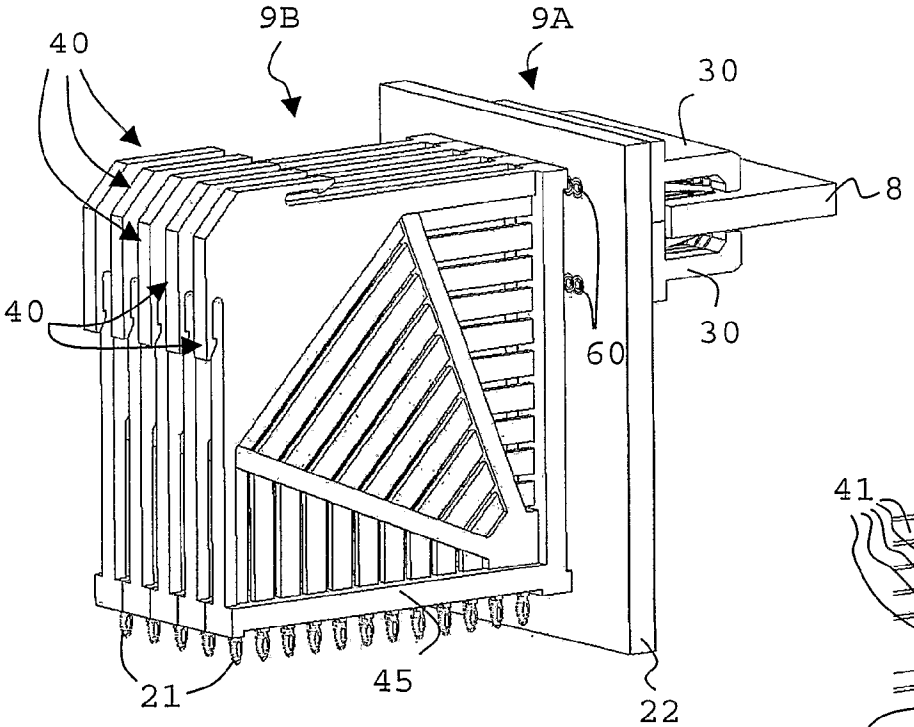
Figure 7A:
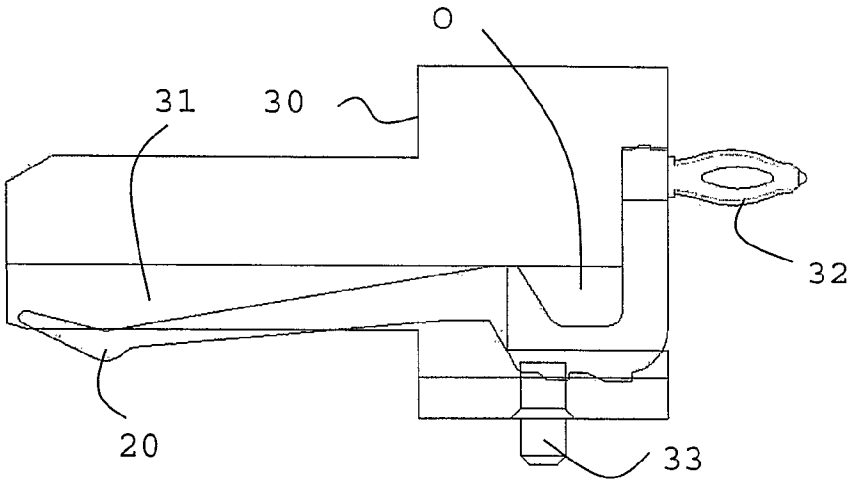
FIGS. 7A-7C show detailed portions of the board-to-board connector of FIG. 2 with adapted first board contacts.
Figure 7B:
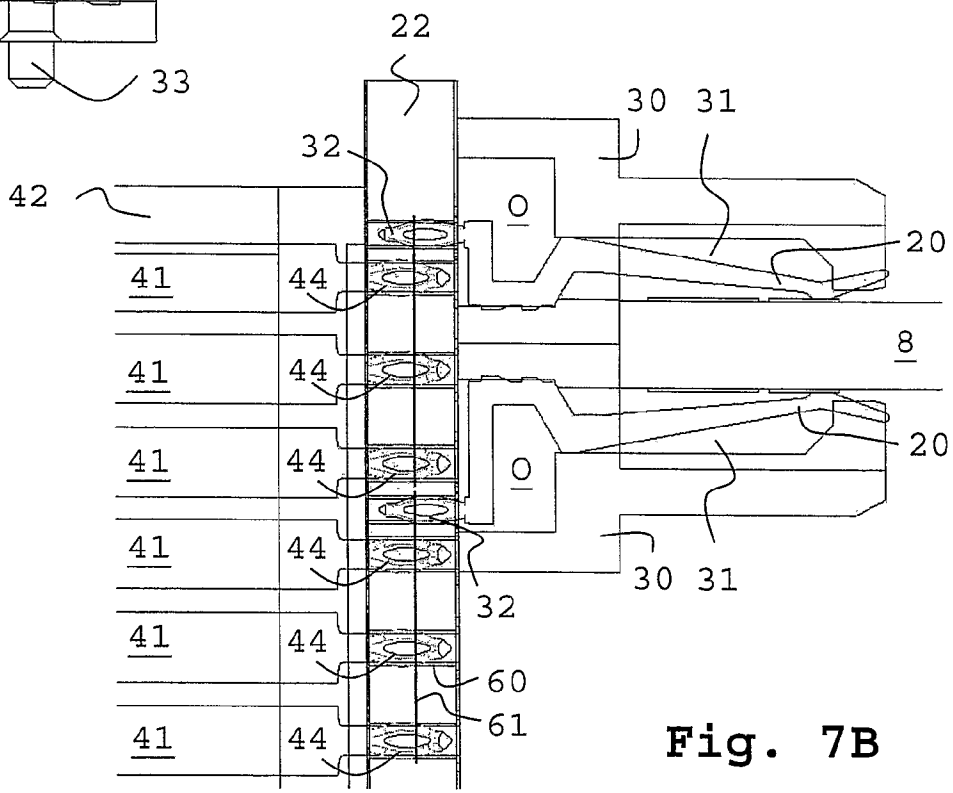
Figure 7C:
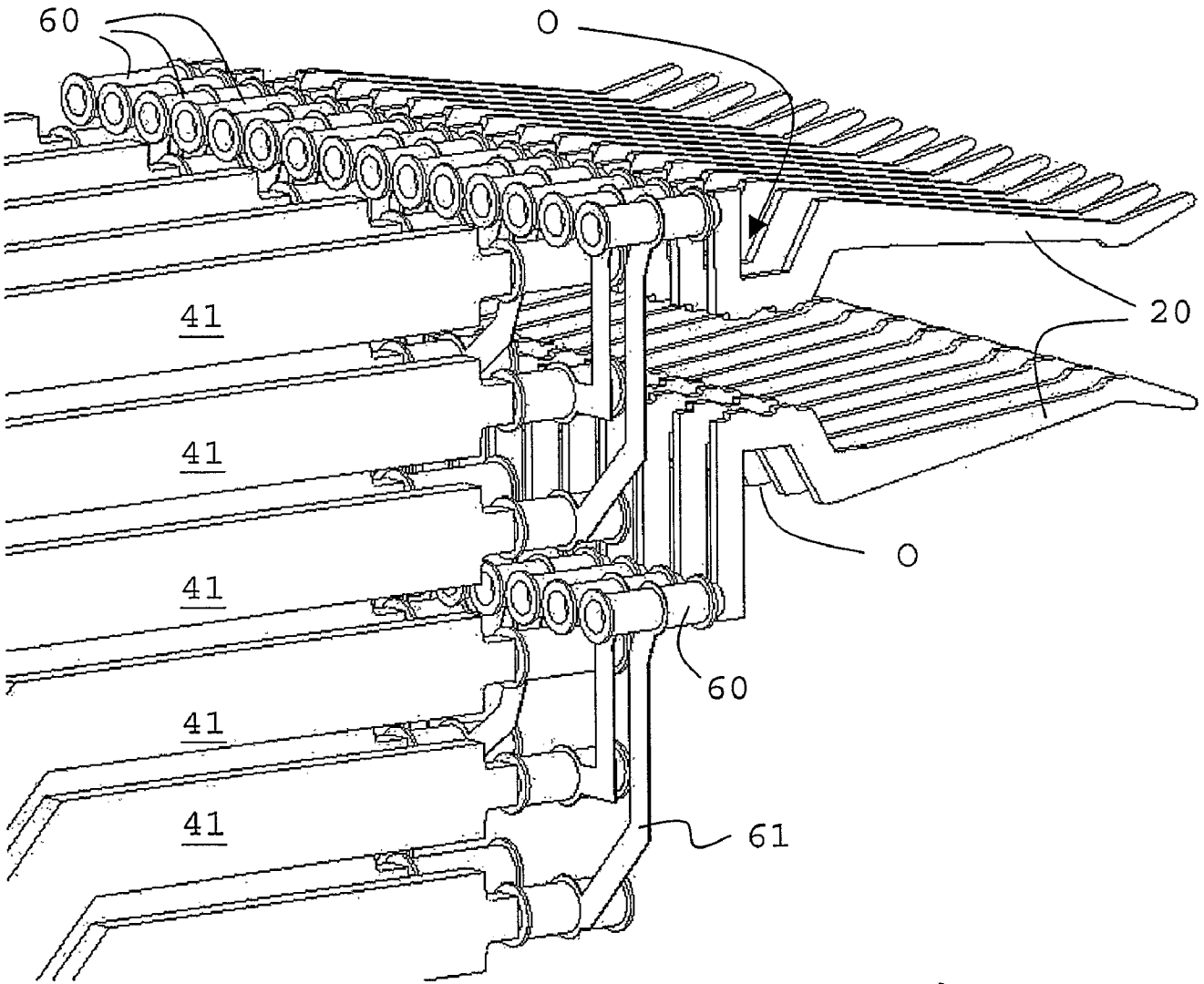
Figure 8B:
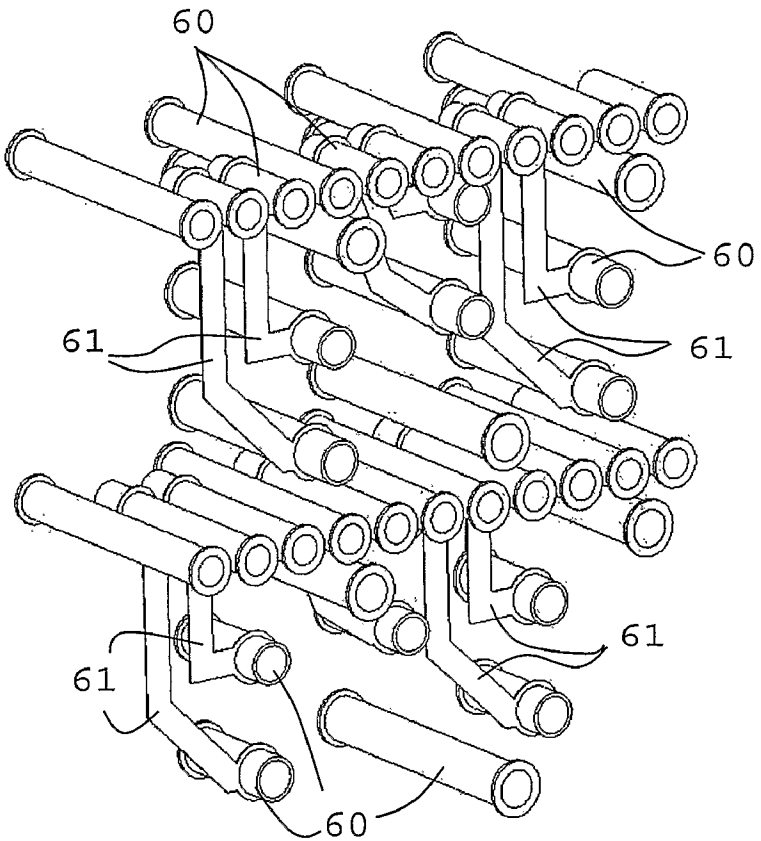
FIGS. 8A and 8B show conductive tracks and vias without the e interconnection element according to an embodiment of the invention.
Figure 8A:
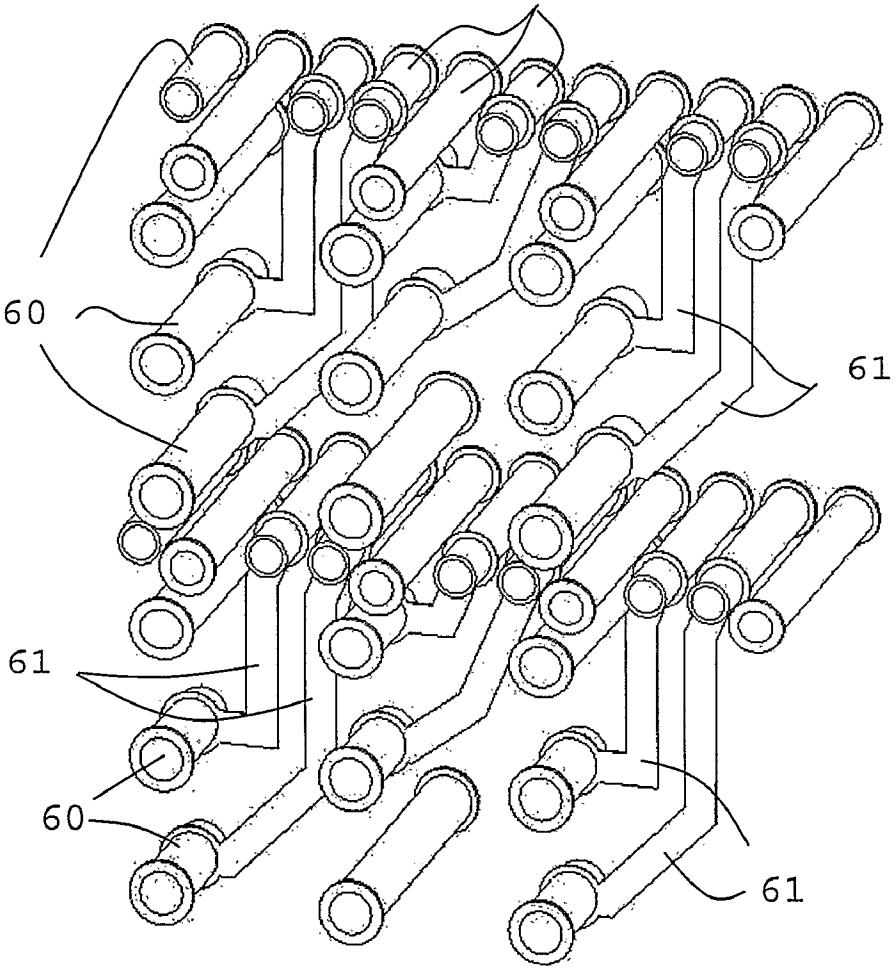

It is noted that the rear end 34 is shown as a metallic plate in FIG. 6B. This metallic plate 34 may be appropriate for low speed applications, but may result in disturbing capacitance effects for higher speeds. Accordingly, the surface area for this plate may be kept low or negligible to avoid such disturbance. This is shown in FIGS. 7A-7C, wherein a major part of the metallic plate 34 is cut-away to leave an opening O.

The vias 60 are electrically connected by means of conductive tracks 61 in the PCB 22. As most clearly observed from FIGS. 8A and 8B (the PCB 22 is omitted in these Figs. for clarity purposes), the vias 60 for transmitting signals are drilled to avoid stubbing. Drilled vias 60 are displayed as shorter vias. More specifically, the vias 60 connecting to the press-fit connections 32 and the vias 60 connecting to the press-fit connections 44 are drilled from opposite sides of the PCB 22.

The conductive tracks 61 allow appropriate routing of signals between the board contacts 20 and 21. Moreover, the conductive tracks 61 may be given different lengths. This feature is particularly advantageous to compensate for signal delay, also referred to as skew. As the conductive leads 41 of the IMLA's 40 have different lengths as a result of the right-angled linear arrangement, a connector embodiment applying such contact arrays 40 inherently suffers from skew effects. Typical signal delays are in the picoseconds range. By designating conductive tracks 61 of larger lengths to conductive leads 41 of short lengths, the overall signal delay between successive board contacts 20, 21 can be reduced or eliminated.

Further, configuration of the conductive tracks 61 can be used for impedance control.

Figure 9B:
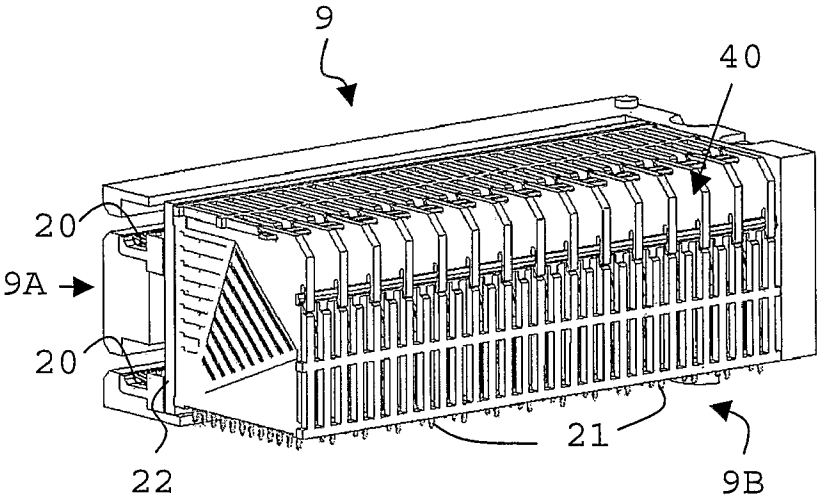
FIGS. 9A-9C show board-to-board connectors according to a second, third respectively fourth embodiment of the invention.
Figure 9A:
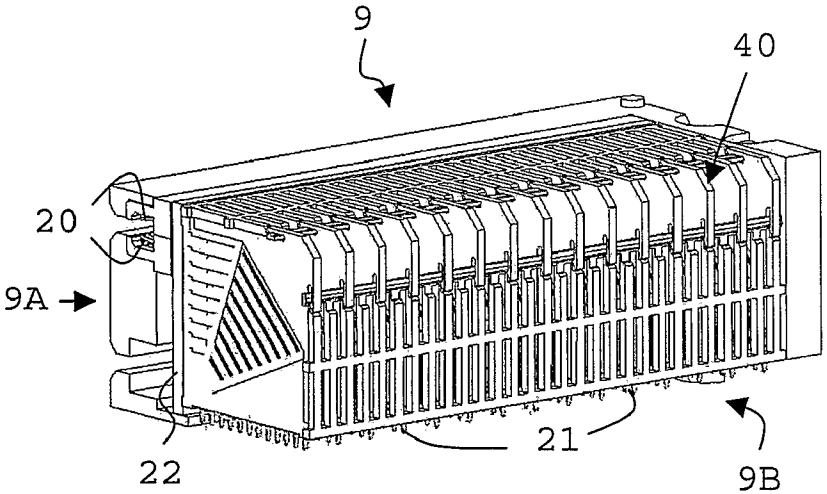
Figure 9C:
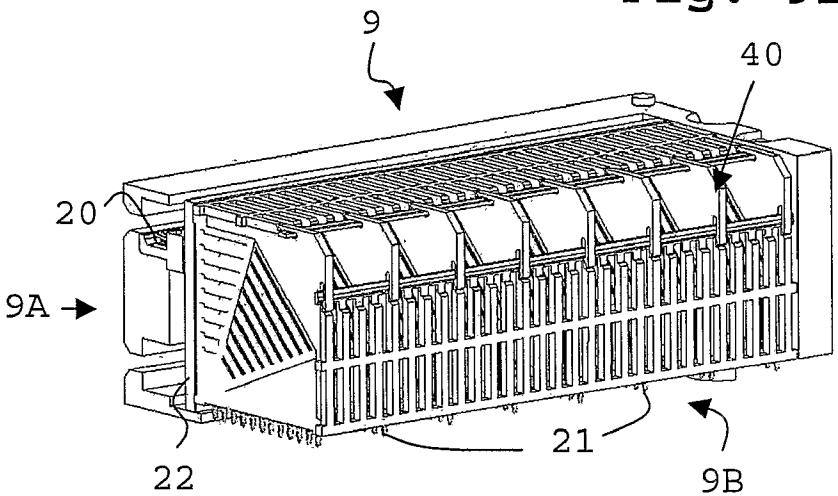

FIGS. 9A-9C show board-to-board connectors 9 according to a second, third respectively fourth embodiment of the invention. In particular FIG. 9A displays a B+ board-to-board connector 9, FIG. 9B is an AB board-to-board connector 9 and FIG. 9C depicts a B board-to-board connector 9 according the convention described previously. Each of these connectors 9 employ less IMLA's 40 than the connector shown in FIG. 2 as a result of the reduced amount of first board contacts 20. Identical reference numerals have been applied to indicate identical or similar features of the board-to-board connectors.

The shown embodiments clarify a relevant advantage of the modular board-to-board connector 9 according to the invention. The several types of connectors A+B+, B+, AB and B can be provided using the same contact modules 9A, 9B and only require the PCB 22 to be chosen in conformance with the intended application. The housing 23 can be loaded with holders 30 of first set(s) of board contacts 20 and IMLA's 40 to define the second set of board contacts 21.

Figure 10:
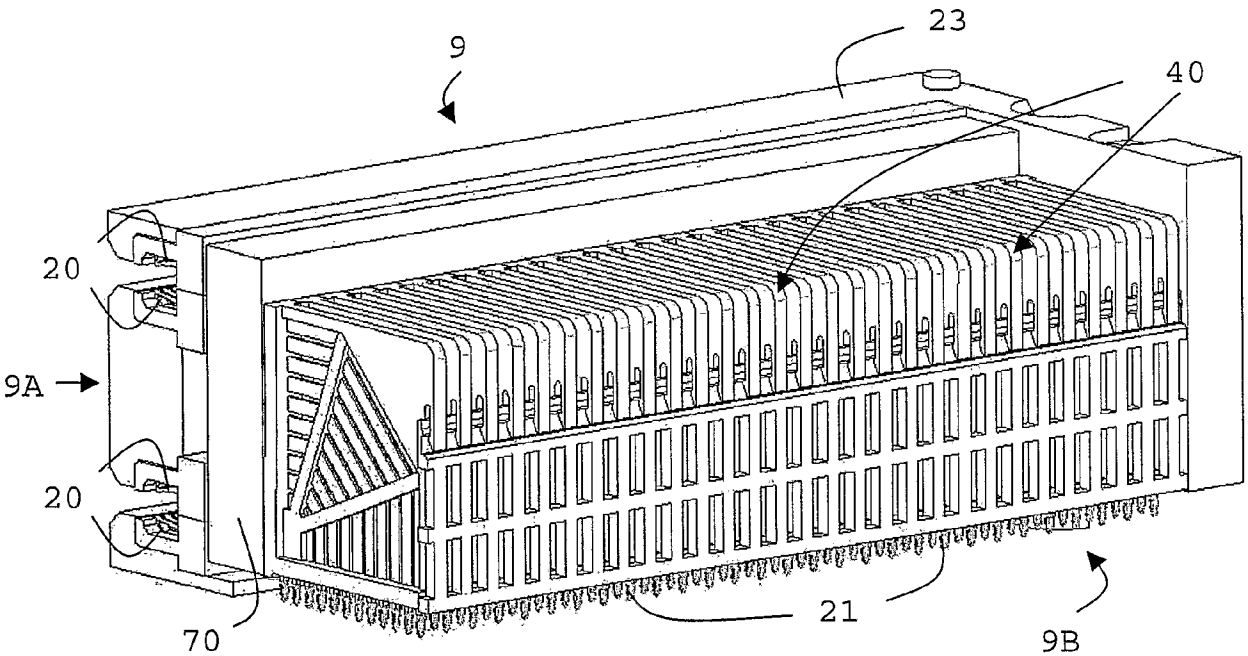
FIG. 10 shows a board-to-board connector according to a fifth embodiment of the invention.
Figure 11:
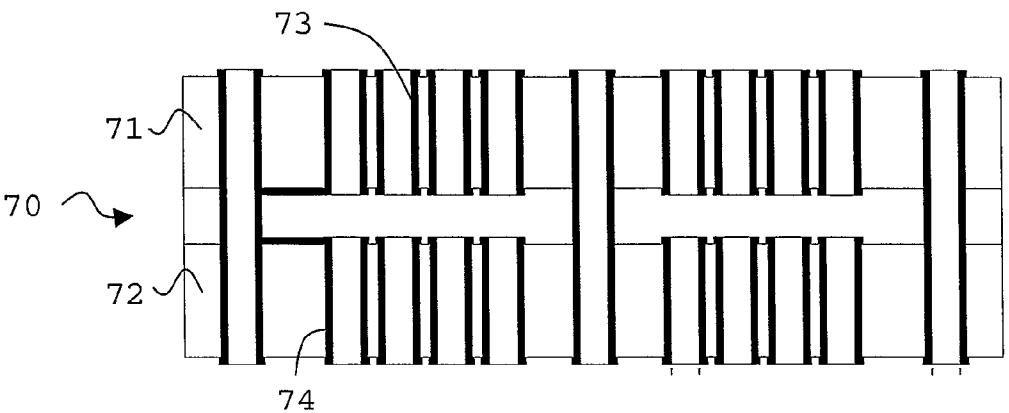
FIG. 11 shows a schematic illustration of an interconnection element according to an embodiment of the invention.

FIGS. 10 and 11 illustrate a board-to-board connector 9 and an interconnection element 70 according to a fifth embodiment of the invention. This embodiment aims to avoid mechanical conflicts between the press-fit connections 32, 44 by employing a sequentially laminated printed circuit board 70. Such a thick PCB 70 employing various layers 71, 72 allows independent definition of a first set of ended vias 73 and a second set of ended vias 74 for the press-fit connections 32 and 44 respectively. The increased thickness of the PCB 22 is compensated by positioning the leads 41 of the IMLA's 40 closer to each other within each IMLA 40.

Figure 12:
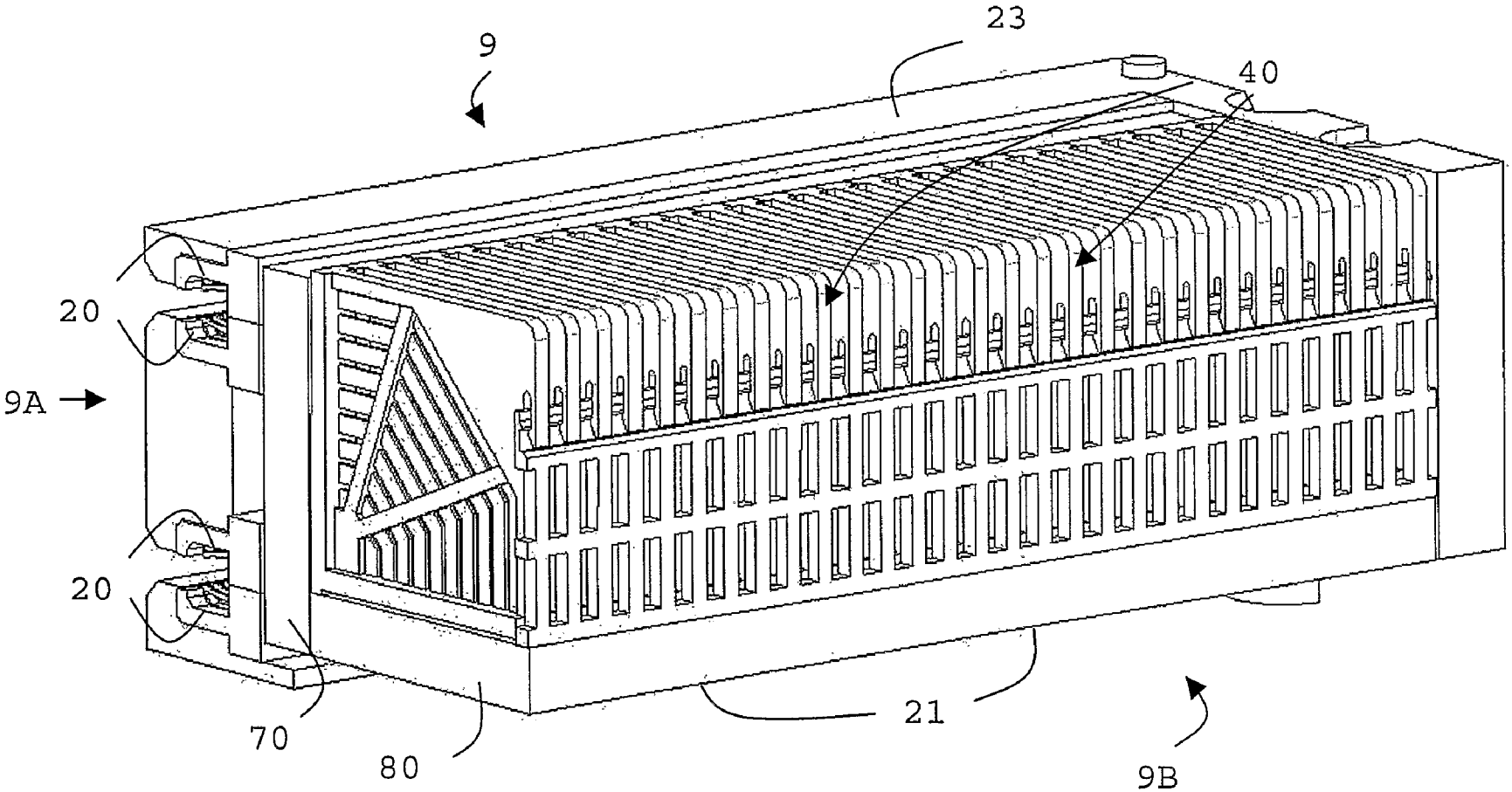
FIG. 12 shows a board-to-board connector according to a sixth embodiment of the invention.

FIG. 12 shows a sixth embodiment of a board-to-board connector 9 according to the invention. Instead of directly using the non-compressive second board contacts 21 of the IMLA's 40 for mounting on the carrier board 6, the second board contacts 21 are transferred as BGA solder points 21 (not visible) to an opposite side of a further PCB 80. The end portions of the conductive IMLA leads 41 are mounted to this further PCB 80 by press-fit connections (not shown). The further printed circuit board 80 allows adaptation to the footprint of the second board 6 of the customer and improves co-planarity with respect to direct application of the BGA solder points 21 on the IMLA leads 41.

Figure 13:
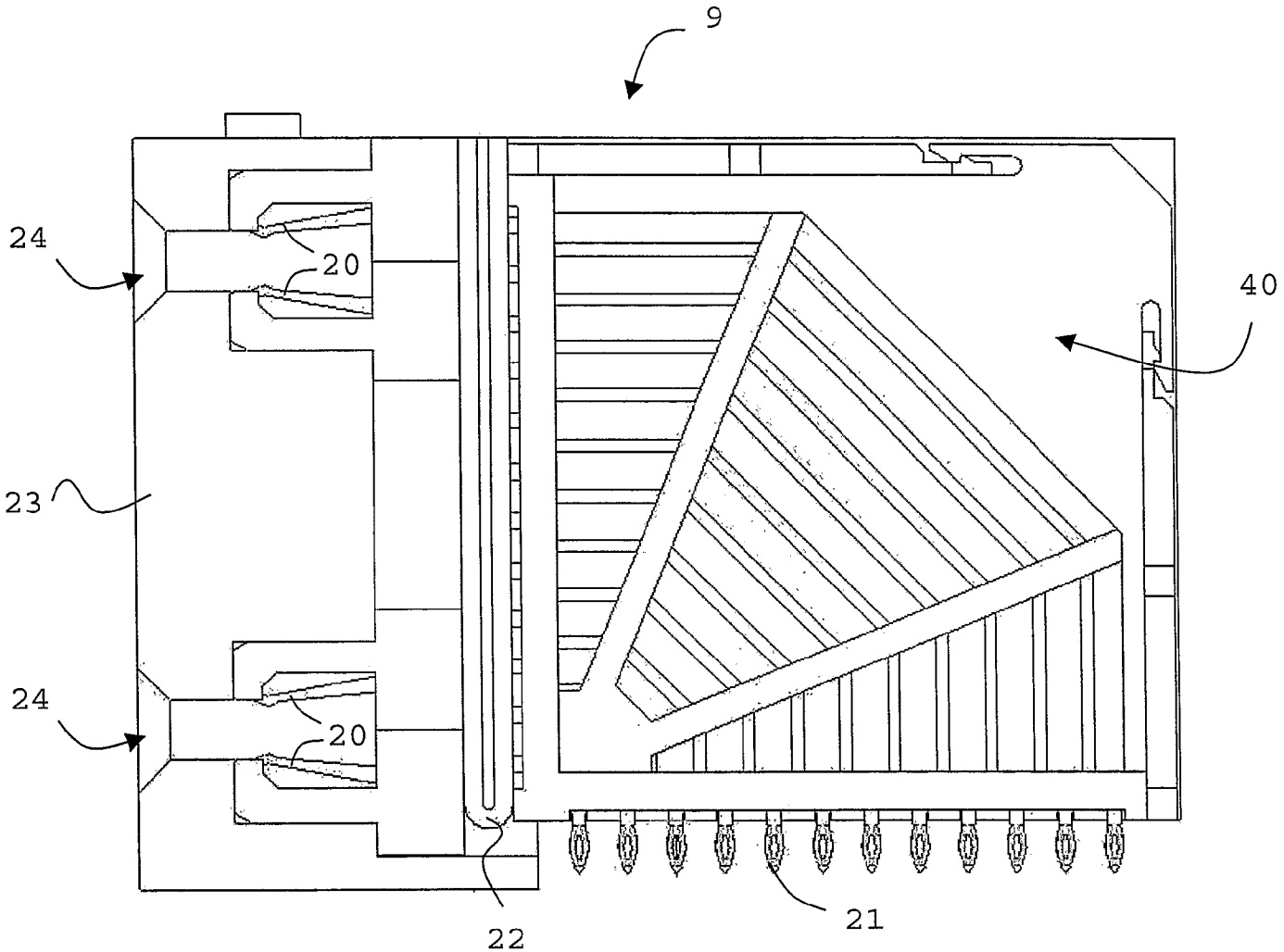
FIG. 13 shows a board-to-board connector according to a seventh embodiment of the invention.

FIG. 13 shows a board-to-board connector 9 in cross-section according to a seventh embodiment of the invention. In the present embodiment, the interconnection element 22 comprises a flexcircuit. It is noted that the interconnection element 22 may alternatively or in addition to a printed circuit element comprise a plastic or other material type element with tracks to fulfil the interconnection task or a series of vias 60 suspended in air.

It is noted that the invention is not limited to the presented embodiments. The gist of the invention relates to the use of an interconnection element within a board-to-board connector for ease of rerouting the first and second board contacts and to obtain a flexible, preferably modular design. The interconnection element inside the connector may be used to compensate for skew generated e.g. by the construction of the connector itself. The gist of the invention also relates to the use of PCB-technology within a board-to-board connector, which may be enhanced by non-compressive termination technology, in particular press-fit technology.

The invention claimed is:

1. A board-to-board connector, comprising:

at least a first contact module with a set of electrical contacts configured to mechanically and electrically connect to a first board; and a second contact module including an insulating housing with electrically conductive leads supported by the insulating housing, the electrically conductive leads defining first and second opposed contacts, the first contacts configured to be mechanically and electrically connect to the first board, and the second contacts configured to mechanically and electrically connect to a second board, wherein the first and second contacts extend out from the insulating housing in first and second respective directions, and the first direction is substantially perpendicular to the second direction, and an interconnection element having opposed first and surfaces, wherein the first contact module is configured to be mounted on the first surface and the second contact module is configured to be mounted on the second surface so as to electrically connect at least one of said set of electrical contacts with at least one of said leads, wherein the first contact module is arranged in a pair of spaced rows that are each independently configured to electrically connect to different boards and the first board, and the second contact module overlaps both rows of the first contact module with respect to a direction perpendicular to the first and second surfaces of the interconnection element when the first and second contact modules are mounted onto the first and second surfaces, respectively, of the interconnection element.

2. The board-to-board connector according to claim 1, wherein said set of electrical contacts is disposed in a first arrangement and said leads are disposed in a second arrangement, said second arrangement being different from said first arrangement.

3. The board-to-board connector according to claim 2, wherein said first arrangement comprises a substantially linear array of contacts and said second arrangement comprises a two-dimensional array of leads.

4. The board-to-board connector according to claim 3, wherein said set of electrical contacts comprises edge type board contacts configured to receive an edge of a circuit board.

5. The board-to-board connector according to claim 1, wherein said interconnection element comprises at least one printed circuit element with one or more conductive tracks for electrically connecting said set of electrical contacts and said leads.

6. The board-to-board connector according to claim 5, wherein said printed circuit element comprises a sequentially laminated printed circuit board.

7. The board-to-board connector according to claim 6, wherein said sequentially laminated printed circuit board comprises a first set of vias in a first layer of said laminated printed circuit board that is associated with set first set of board contacts and a second set of vias in a second layer of said sequentially laminated printed circuit board that is associated with said leads, the second layer different than the first layer.

8. The board-to-board connector according to claim 5, wherein said one or more conductive tracks comprise associated vias.

9. The board-to-board connector according to claim 5, wherein at least two of said conductive tracks have different track lengths.

10. The board-to-board connector according to claim 5, wherein the conductive track impedance is controlled by configuring said conductive tracks.

11. The board-to-board connector according to claim 1, wherein said leads of said second contact module extend conductive leads extending in a lead frame from said interconnection element.

12. The board-to-board connector according to claim 11, wherein said second contact module comprises at least a first contact array and a second contact array of electrically conductive leads extending in respectively a first and second frame and wherein said second lead frame is disposed adjacent to said first frame.

13. The board-to-board connector according to claim 12, wherein said second contact module comprises a linear contact array of edge coupled electrically conductive leads.

14. The board-to-board connector according to claim 13, wherein said board-to-board connector can transmit signals in excess of about 1.0 Gb/sec with a near end cross talk less than about 3% and far-end cross talk of less than about 4%.

15. The board-to-board connector according to claim 14, wherein said leads are selected from the group comprising solder pins, press-fit contacts, pin-in-paste contacts and ball grid array contacts.

16. The board-to-board connector according to claim 15, wherein said first opposed contacts are configured to contact a printed circuit board at a first end of the leads and the second opposed contact comprises ball grid array solder points at a second end of the leads adapted to connect to a board.

17. The board-to-board connector according to claim 1, wherein said first board comprises the interconnection element and said second contact module is connected to said interconnection element by press-fit connections.

18. The board-to-board connector according to claim 1, wherein said connector is a mezzanine connector.

19. The board-to-board connector according to claim 1, the second contact module, comprising:

a contact array of electrically conductive leads extending in a frame accommodating said conductive leads between a first row of board contacts and a second row of board contacts, wherein said electrically conductive leads are separated by gaps with air as a dielectric.

20. The board-to-board connector according to claim 19, wherein said first and second rows of board contacts are selected from the group comprising solder pin contacts, press-fit contacts, pin-in-paste contacts and ball grid array contacts.

21. The board-to-board connector according to claim 1, wherein the first opposed contacts of the leads are selected from at least one of solder pins, press-fit contacts, pin-in-paste contacts and ball grid array contacts, and the second opposed contacts are configured to attach to the interconnection element.

22. The board-to-board connector according to claim 21, wherein the interconnection element is elongate in a direction perpendicular with respect to a row of the second opposed contacts.

23. The connector assembly according to claim 1, wherein the first contact module defines an outer footprint that interfaces with the interconnection element when the first contact module is mounted onto the interconnection element, and the footprint of the first contact module is smaller than the footprint of the second contact module.

24. The board-to-board connector according to claim 1, wherein the leads are right-angle leads.

25. The board-to-board connector according to claim 1, wherein the set of electrical contacts of the first contact module are configured to connect to the first board at one end, and are further configured to connect to a third board at a second end that is opposite the first end.

26. The board-to-board connector according to claim 25, wherein the fourth set of board contacts is configured to receive the third board.

27. The board-to-board connector according to claim 1, wherein the second contact module further comprises an insert molded leadframe assembly.

28. The board-to-board connector according to claim 1, wherein the first and second circuit boards are oriented at a right angle with respect to each other when the first and second contacts are connected to the first and second circuit boards.

* * * * *